US006074046A

United States Patent [19]

Wen

[11] Patent Number: 6,074,046

[45] Date of Patent: Jun. 13, 2000

[54] PRINTER APPARATUS CAPABLE OF VARYING DIRECTION OF AN INK DROPLET TO BE EJECTED THEREFROM AND METHOD THEREFOR

[75] Inventor: Xin Wen, Rochester, N.Y.

[73] Assignee: Eastman Kodak Company, Rochester, N.Y.

[21] Appl. No.: 09/036,012

[22] Filed: Mar. 6, 1998

[51] Int. Cl.[7] ..... B41J 2/045

[52] U.S. Cl. ..... 347/68

[58] Field of Search ..... 346/68; 347/9, 347/10, 11, 12, 68, 69, 70, 71, 72

[56] References Cited

U.S. PATENT DOCUMENTS

| | | | |
|---|---|---|---|
| 5,023,625 | 6/1991 | Bares et al. | 346/1.1 |
| 5,172,141 | 12/1992 | Moriyama | 346/140 R |
| 5,594,475 | 1/1997 | Komakine et al. | 347/9 |

*Primary Examiner*—Arthur T. Grimley
*Assistant Examiner*—Hoang Ngo
*Attorney, Agent, or Firm*—Walter S. Steven

[57] ABSTRACT

Printer apparatus capable of varying direction of an ink droplet to be ejected therefrom and method therefor. The apparatus includes a printhead having a first side wall and a second side wall defining a channel therebetween having an ink body residing therein. The first side wall and the second side wall are selectively movable for asymmetrically pressurizing the ink body. Selective movement of the first side wall asymmetrically pressurizes the ink body to eject the ink droplet therefrom and out the channel along a first predetermined direction. Moreover, selective movement of the second side wall asymmetrically pressurizes the ink body to eject the ink droplet therefrom and out the channel along a second predetermined direction. A pulse generator supplies a first electrical pulse to the first wall and a second electrical pulse to the second wall, so that the first and the second walls are selectively moved in a manner providing for variable ejection direction of the ink droplets. Cut-outs between neighboring ink channels reduce mechanical cross-talk between channels, which cross-talk would otherwise interfere with precise ejection of ink droplets.

34 Claims, 9 Drawing Sheets

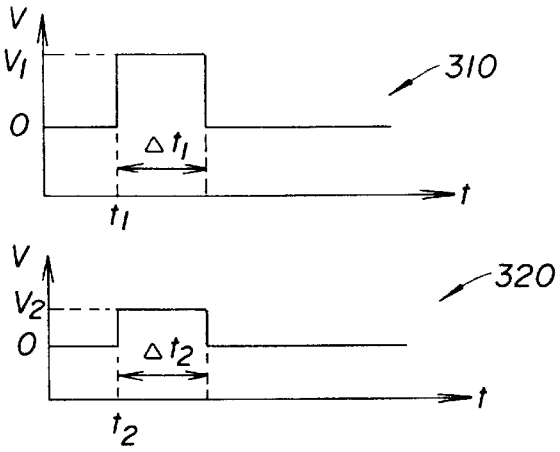
Fig.11a
Fig.11b
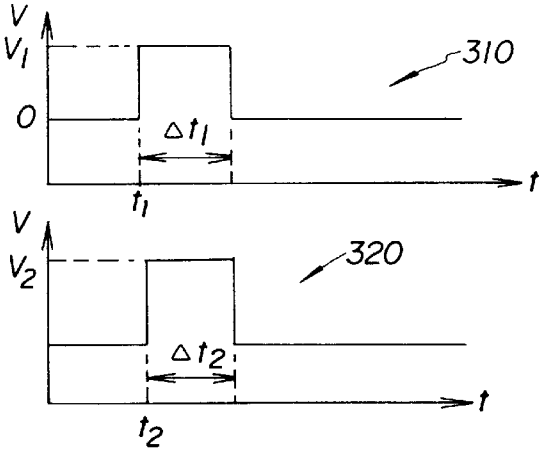
Fig.12a
Fig.12b
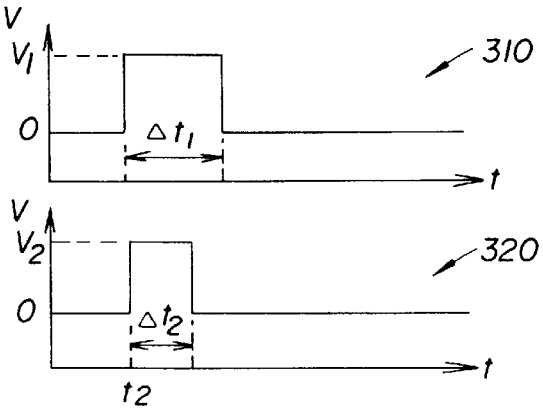
Fig.13a
Fig.13b
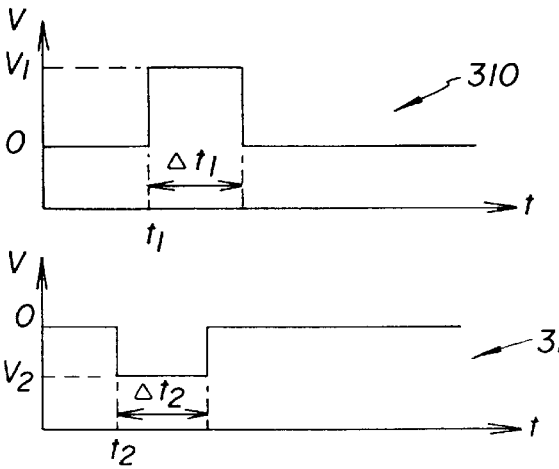
Fig.14a
Fig.14b

PRINTER APPARATUS CAPABLE OF VARYING DIRECTION OF AN INK DROPLET TO BE EJECTED THEREFROM AND METHOD THEREFOR

BACKGROUND OF THE INVENTION

The present invention generally relates to printing apparatus and methods and more particularly relates to a printer apparatus, and method therefor, capable of varying direction of an ink droplet therefrom for improved accuracy of ink droplet placement.

An ink jet printer produces images on a receiver medium by ejecting ink droplets onto the receiver medium in an image-wise fashion. The advantages of non-impact, low-noise, low energy use, and low cost operation in addition to the capability of the printer to print on plain paper are largely responsible for the wide acceptance of ink jet printers in the marketplace.

However, one problem associated with piezoelectric ink jet printers is placement errors of the ink droplets on the receiver medium. Such errors are due, for example, to variability in the print head manufacturing process. That is, during the print head manufacturing process, ink nozzles, which are attached to the print head, are not made identical. These manufacturing variabilities may also result in asymmetric placement of ink nozzles in a nozzle plate with respect to ink channels that otherwise should be aligned with respective ones of the nozzles. In addition, these manufacturing variabilities may result in the nozzles having non-round openings through which the ink droplets must pass. Thus, these nozzles tend to eject ink droplets in directions different from an ideal direction normal to the nozzle plate in which the nozzles are formed. Such misdirected ink droplet ejection causes misplacement of the ink droplets on the receiver medium. These ink droplet placement errors in turn produce image artifacts (i.e., defects) such as banding, reduced sharpness, extraneous ink spots, ink coalescence and color bleeding.

One method to reduce directional errors in the ejected ink droplets is to minimize the distance between the print head and the receiver medium. Minimizing distance between the print head and receiver medium minimizes error represented by the distance on the receiver medium between a correctly placed droplet and a misplaced droplet. However, a limitation of this method is that if the print head is arranged too close to the receiver medium, there is an increased risk that ink in the ink nozzles will contact the receiver medium even before ink ejection occurs. When this occurs, the ink spreads-out across the receiver medium in a uncontrolled manner to contaminate the receiver medium.

Another problem associated with ink jet printers of the piezoelectric type is so-called mechanical "cross-talk" between ink channels forming an ink jet printhead. Cross-talk between the channels interferes with precise ejection of ink droplets from neighboring channels, which in turn reduces accuracy of ink droplet placement on the receiver medium.

Techniques to improve ink droplet placement and to reduce cross-talk are known. An ink jet printhead capable of changing direction of ejected ink droplets and having negligibly low mechanical over-coupling from one channel to another is disclosed in U.S. Pat. No. 4,842,493 titled "Piezoelectric Pump" issued Jun. 27, 1989 in the name of Kenth Nilsson. This patent discloses a piezoceramic wafer into which grooves have been sawed from the upperside and underside of the wafer. The grooves on the upperside and underside of the wafer lay offset relative to one another and partially overlap. The grooves on the upperside of the wafer eject ink droplets while the grooves on the underside of the wafer, which are offset from the ink grooves on the upperside of the wafer, contain only air. In this manner, deformation of the walls of one ink groove is hardly at all transmitted to another ink groove because adjacent ink grooves are effectively separated by an intervening air-filled groove.

Moreover, U.S. Pat. No. 4,842,493 to Kenth Nilsson also discloses that direction of the ejected ink droplets can be changed with assistance of a cover which covers the ink grooves. This cover comprises a plurality of channels cut therein. A pair of the channels proceed at an acute angle relative to each of the ink grooves. Ink from an ink groove is caused to flow into a selected one of the two channels associated with each ink groove. In this manner, ink droplets depart the printhead in a direction corresponding to the acute angle of the selected channel.

However, although the Nilsson device includes a cover having channels for directing ink droplet ejection, the device disclosed in the Nilsson patent does not appear to provide for easily changing direction of ink droplet ejection as the printhead operates. That is, the channels formed in the cover of the Nilsson device are machined when the printhead is manufactured and therefore maintain their fixed acute angle during operation. A new cover must apparently be machined to replace an existing cover when change in direction of ink droplet ejection is desired. Thus, the Nilsson device appears to require disassembly of the device to vary ejection direction of ink droplets. Such a cover change-out is inconvenient and costly during field use of an ink jet printer. Thus, the Nilsson device does not appear to provide for variable change in ink droplet direction during operation. Moreover, although the Nilsson device provides for reduction in "cross-talk", the Nilsson device does not appear to provide reduction in cross-talk in combination with variable change in ink droplet direction.

Therefore, there has been a long-felt need to provide a printer apparatus, and method therefor, capable of varying direction of an ink droplet therefrom for improved accuracy of ink droplet placement.

SUMMARY OF THE INVENTION

The invention resides in a printer apparatus, comprising a printhead having a plurality of selectively movable side walls defining a chamber therebetween and a plurality of actuators coupled to respective ones of the side walls for selectively moving the side walls to asymmetrically pressurize the chamber.

In one aspect of the invention, the apparatus includes a printhead having a first side wall and a second side wall defining a channel therebetween having an ink body residing therein. The first side wall and the second side wall are selectively movable for asymmetrically pressurizing the ink body. A first actuator is coupled to the first side wall and a second actuator is coupled to the second side wall for selectively moving the first side wall and the second side wall. In this manner, movement of the first side wall asymmetrically pressurizes the ink body to eject the ink droplet therefrom and out the channel along a first predetermined direction. Moreover, movement of the second side wall asymmetrically pressurizes the ink body to eject the ink droplet therefrom and out the channel along a second predetermined direction. A controller connected to the actuators is also provided for controllably actuating the actuators. The apparatus further comprises a pulse generator coupled to the actuators for supplying a first electrical pulse to the first actuator and a second electrical pulse to the second actuator, so that the first and second actuators are selectively actuated in a manner providing for varying ejection direction of the ink droplets. Cut-outs between neighboring ink channels reduce mechanical cross-talk between channels, which cross-talk would otherwise interfere with precise ejection of ink droplets from neighboring channels and reduces accuracy of ink droplet placement on a receiver medium.

An object of the present invention is to provide a printer apparatus and method capable of varying direction of an ink droplet to be ejected therefrom.

Another object of the present invention is to increase number of tone scales which are produced by the printhead.

A feature of the present invention is the provision of a printhead having two selectively movable side walls defining a channel therebetween having an ink body therein, the side walls being selectively movable for asymmetrically pressurizing the ink body.

Another feature of the present invention is the provision of a cut-out between neighboring ink channels to mechanically decouple the neighboring ink channels.

An advantage of the present invention is that direction of ejection of an ink droplet from the ink body can be controlled as the ink body is asymmetrically pressurized.

Another advantage of the present invention is that mechanical "cross-talk" between neighboring ink channels is reduced.

Yet another advantage of the present invention is that ink droplet ejection direction may be easily varied without disassembly of the printer apparatus.

Still another advantage of the present invention is that volume of ink droplets ejected is controlled.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

FIG. 11*a* is a graph illustrating a first electrical pulse as a function of time, the first electrical pulse having a predetermined amplitude, width and start time;

FIG. 11*b* is a graph illustrating a second electrical pulse as a function of time, the second electrical pulse having a predetermined amplitude less than the amplitude of the first pulse of FIG. 11*a*, but an identical width and start time;

FIG. 12*a* is a graph illustrating a first electrical pulse as a function of time, the first electrical pulse having a predetermined amplitude, width and start time;

FIG. 12*b* is a graph illustrating a second electrical pulse as a function of time, the second electrical pulse having a predetermined amplitude and width identical to the amplitude and width of the first pulse of FIG. 12*a*, but a start time occurring after start time of the first pulse of FIG. 12*a;*

FIG. 13*a* is a graph illustrating a first electrical pulse as a function of time, the first electrical pulse having a predetermined amplitude, width and start time;

FIG. 13*b* is a graph illustrating a second electrical pulse as a function of time, the second electrical pulse having a predetermined amplitude and start time identical to the amplitude and start time of the first pulse of FIG. 13*a*, but a width less than the width of the first pulse of FIG. 13*a;*

FIG. 14*a* is a graph illustrating a first electrical pulse as a function of time, the first pulse having a predetermined amplitude, width and start time;

FIG. 14*b* is a graph illustrating a second electrical pulse as a function of time, the second pulse having a negative polarity and also having a pulse width and amplitude identical in absolute value to the amplitude and pulse width of the first pulse of FIG. 14*a*, but a start time occurring before start time of the first pulse of FIG. 14*a*.

DESCRIPTION OF PREFERRED EMBODIMENTS OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
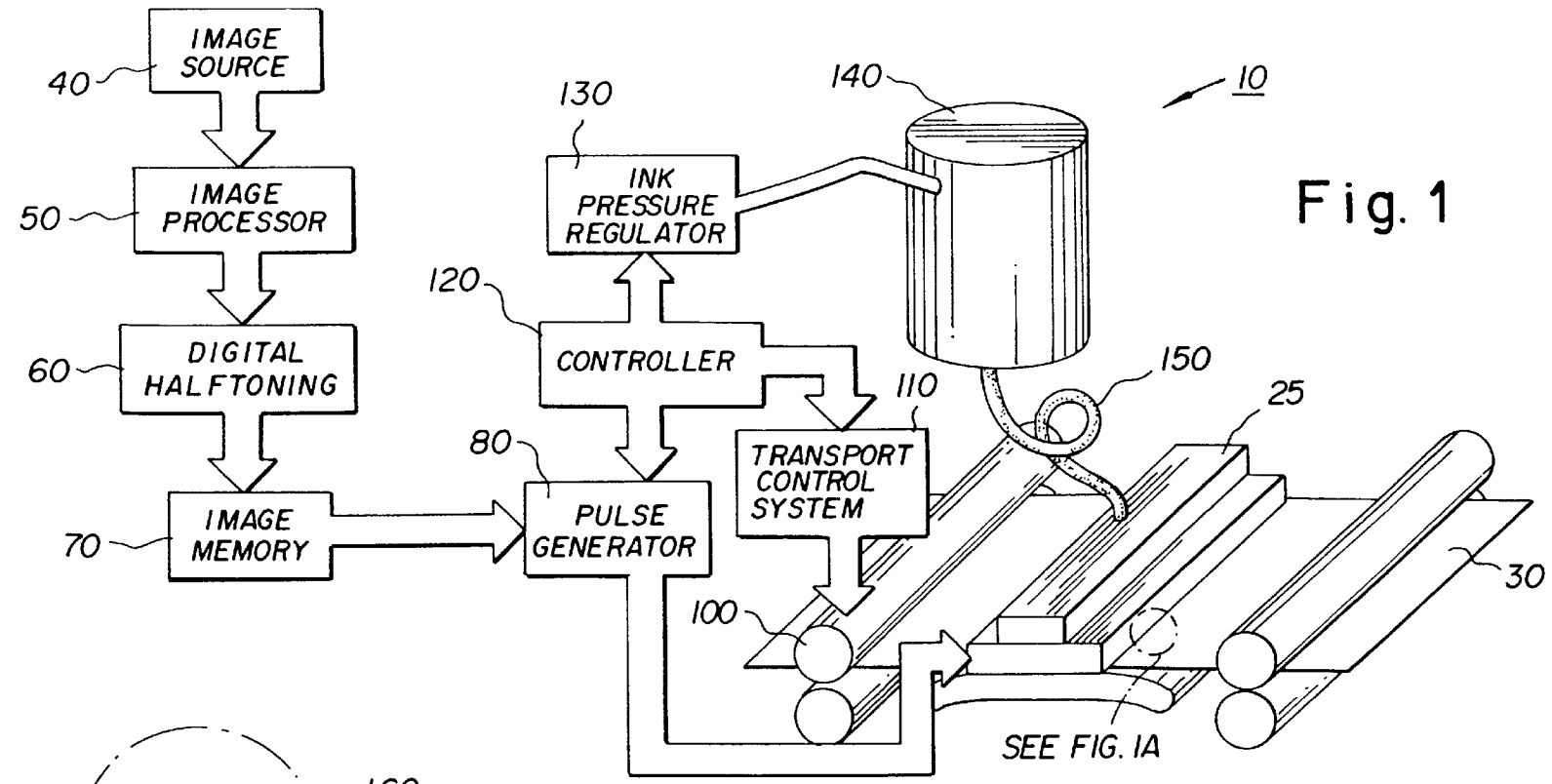
FIG. 1 illustrates a printer apparatus belonging to the present invention, the printer apparatus comprising a printhead having a plurality of neighboring ink channels and cut-outs between neighboring ink channels.
Figure 1A:
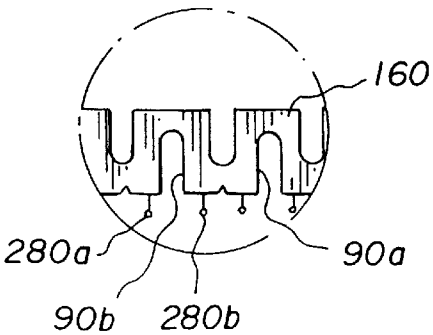
Figure 8:
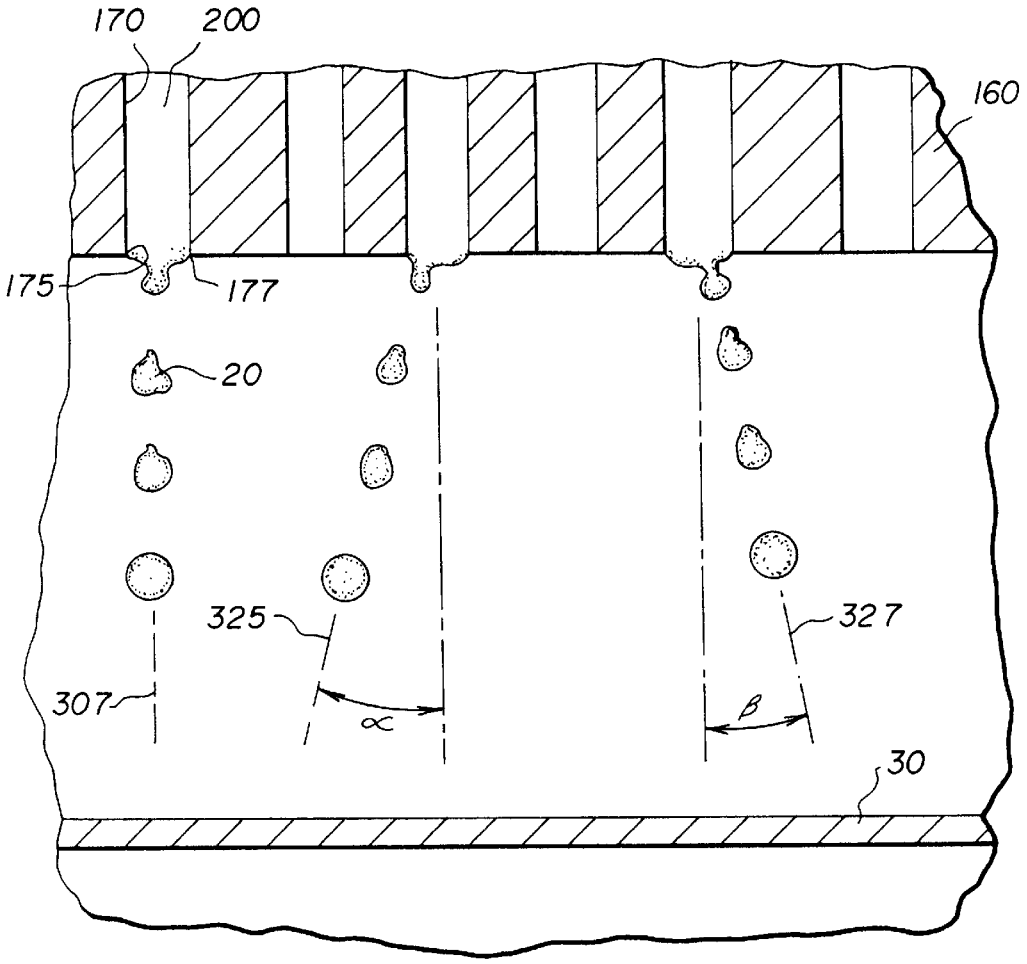
FIG. 8 is a fragmentation view in horizontal section of the printhead, this view showing the ink channels and cut-outs therebetween and also showing ink droplets being ejected from the printhead in variable predetermined directions toward a recording medium.
Figure 9A:
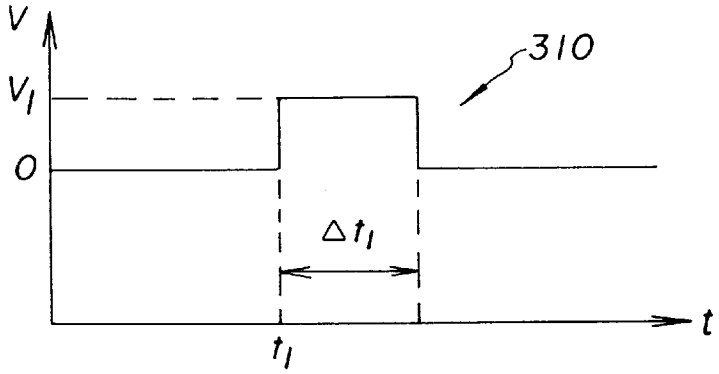
FIG. 9*a* is a graph illustrating a first electrical pulse as a function of time, the first electrical pulse having a predetermined amplitude, width and start time.
Figure 9B:
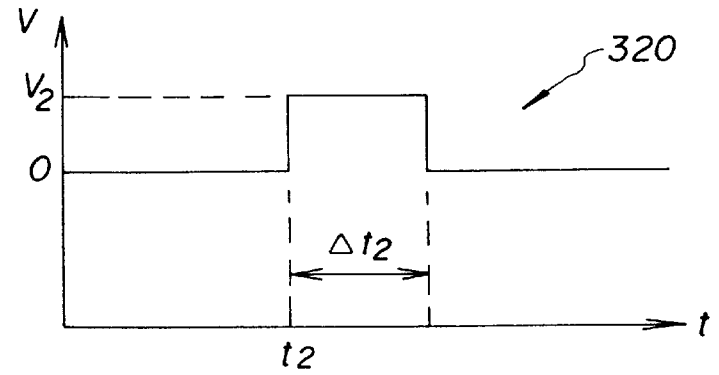
FIG. 9*b* is a graph illustrating a second electrical pulse as a function of time, the second electrical pulse having a predetermined amplitude, width and start time identical to the amplitude, width and start time of the first electrical pulse of FIG. 9*a;*

Therefore, referring to FIG. 1, there is shown a printer apparatus, generally referred to as 10, capable of varying direction of an ink droplet 20 to be ejected from a printhead 25 toward a receiver 30 (see FIG. 8), which may be a reflective-type (e.g., paper) or transmissive-type (e.g., transparency) receiver. As shown in FIG. 1, printer apparatus 10 comprises an image source 40, which may be raster image data from a scanner or computer, or outline image data in the form of a PDL (Page Description Language) or other form of digital image representation. This image data is transmitted to an image processor 50 connected to image source 40. Image processor 50 converts the image data to a pixel-mapped page image. Image processor 50 may be a raster image processor in the case of PDL image data to be converted, or a pixel image processor in the case of raster image data to be converted. In any case, image processor 50 transmits continuous tone data to a digital halftoning unit 60 connected to image processor 50. Halftoning unit 60 halftones the continuous tone data produced by image processor 50 and produces halftoned bitmap image data that is stored in an image memory 70, which may be a full-page memory or a band memory depending on the configuration of printer apparatus 10. A pulse generator 80 connected to image memory 70 reads data from image memory 70 and applies time and amplitude varying electrical pulses to a first electrical actuator 90*a* (i.e., a first electrode) and a second electrical actuator 90*b* (i.e., a second electrode), for reasons described more fully hereinbelow.

Referring again to FIG. 1, receiver 30 is moved relative to printhead 25 by means of a transport mechanism 100, which is electronically controlled by a transport control system 110. Transport control system 110 in turn is controlled by a suitable controller 120. It may be appreciated that different mechanical configurations for transport control system 110 are possible. For example, in the case of pagewidth print heads, it is convenient to move receiver 30 past a stationary printhead 25. On the other hand, in the case of scanning-type print systems, it is more convenient to move printhead 25 along one axis (i.e., a sub-scanning direction) and receiver 30 along an orthogonal axis (i.e., a main scanning direction), in a relative raster motion. In addition, controller 120 may be connected to an ink pressure regulator 130 for controlling regulator 130. Regulator 130 is capable of regulating pressure in an ink reservoir 140. Ink reservoir 140 is connected, such as by means of a conduit 150, to printhead 25 for supplying ink to printhead 25. In this regard, ink is preferably distributed under pressure to a back surface of printhead 25 by an ink channel device (not shown) belonging to printhead 25.

Figure 2:
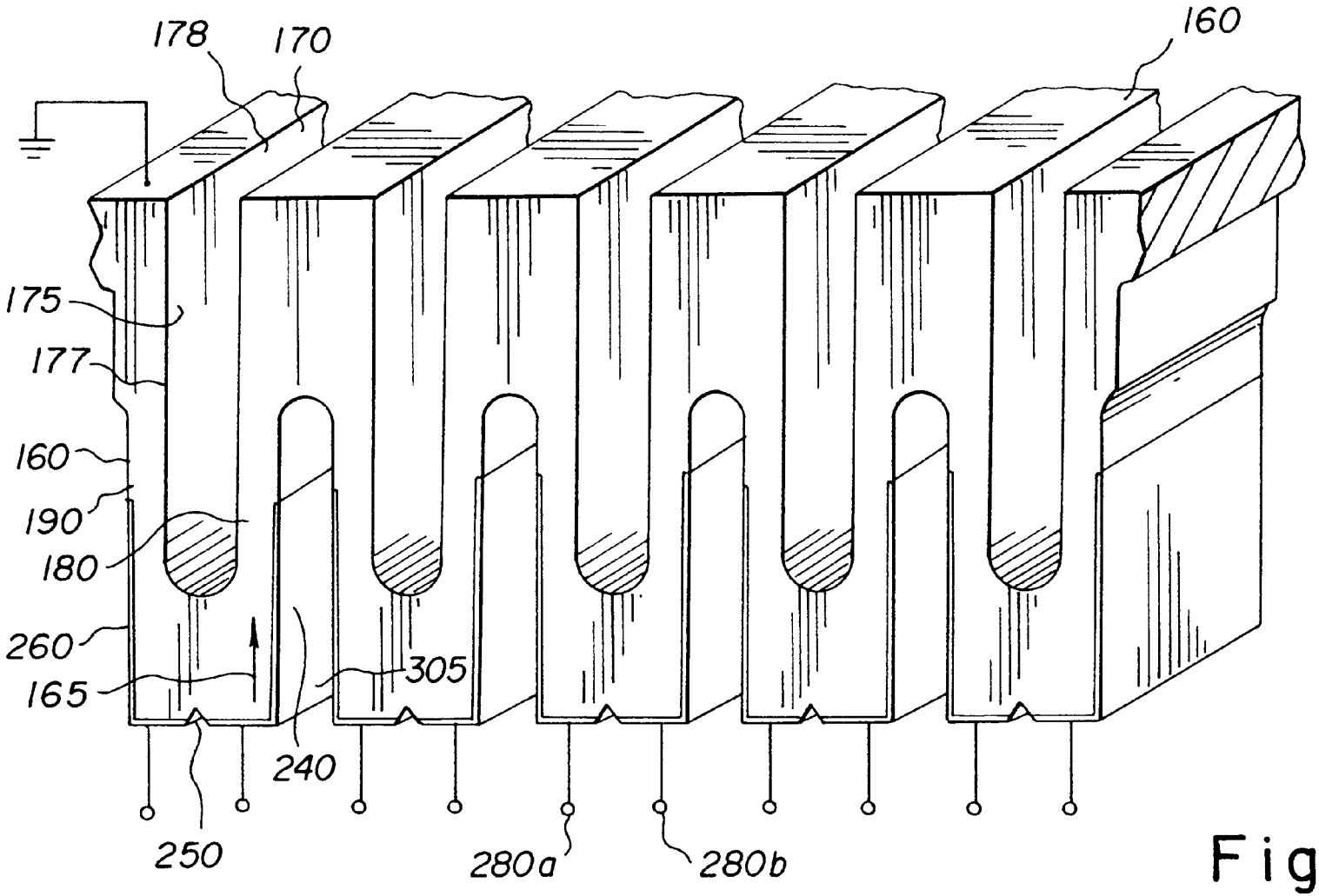
FIG. 2 is a fragmentation view in perspective of the printhead, this view showing the ink channels and cut-outs therebetween.
Figure 3:
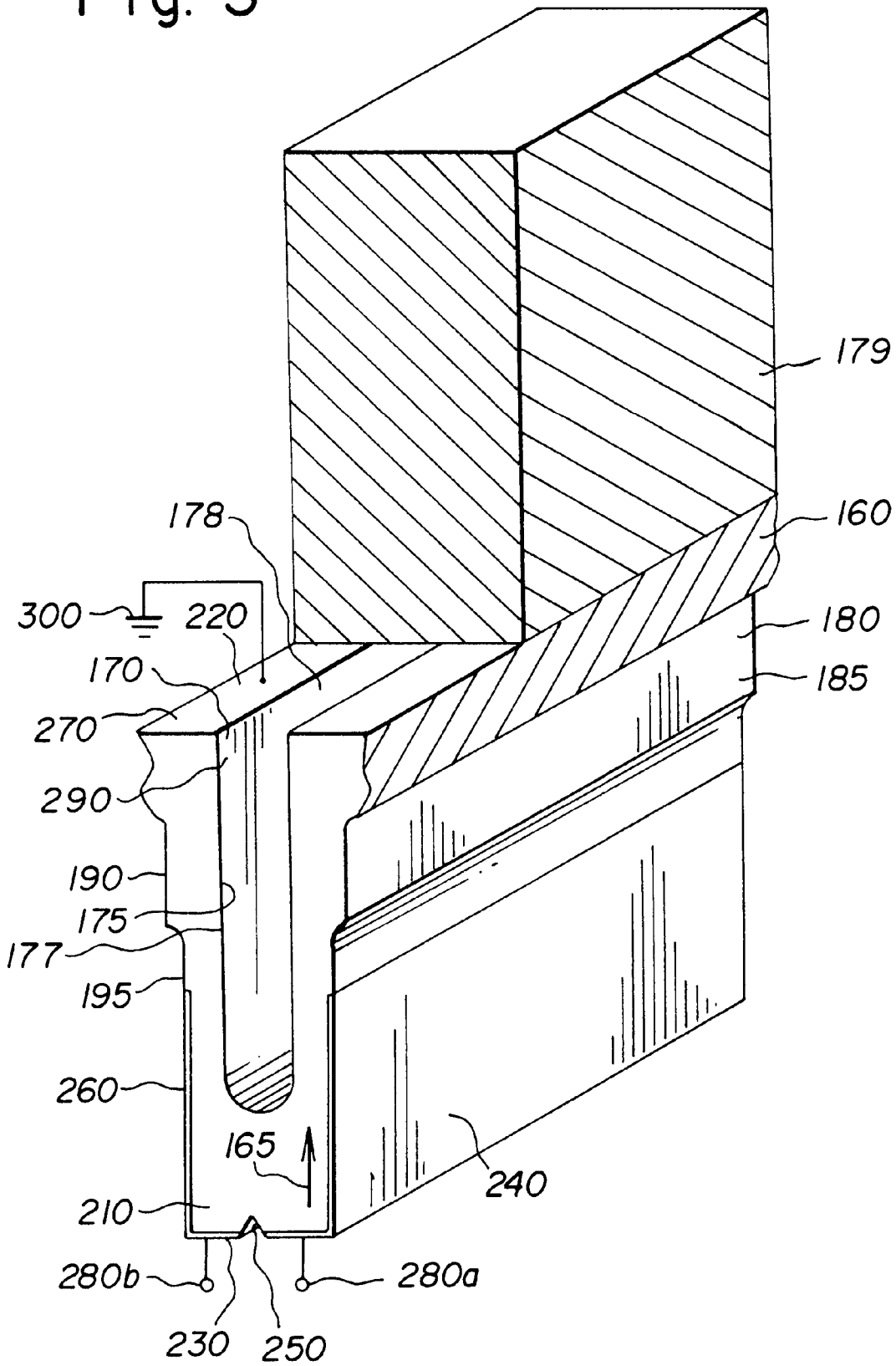
FIG. 3 is a view in perspective of one of the ink channels, which are defined by opposing movable first and second side walls.
Figure 4:
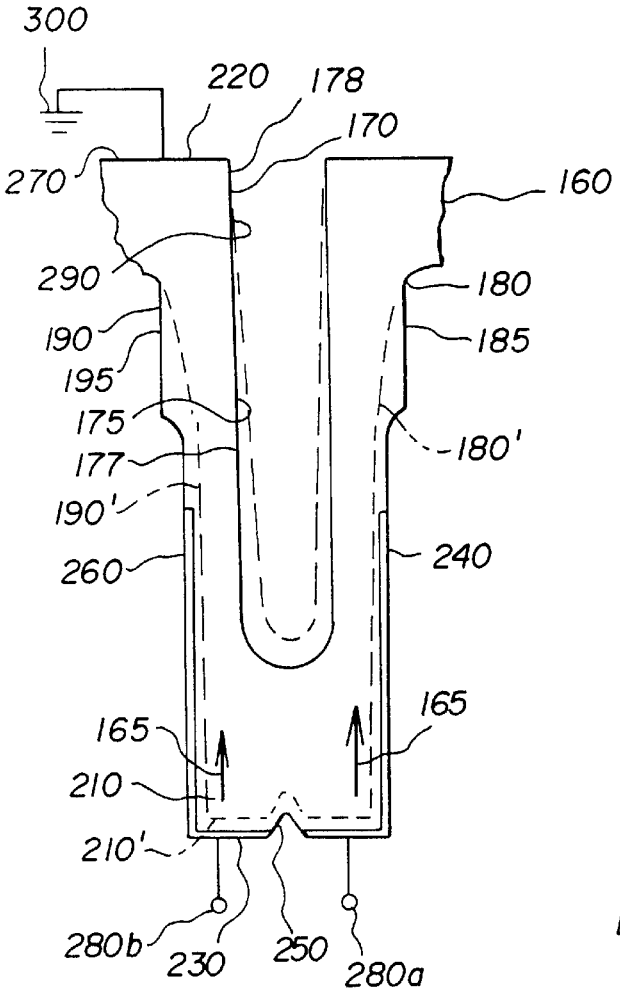
FIG. 4 is a view in elevation of the ink channel, this view showing both of the side walls moving.

Referring to FIGS. 2 and 3, printhead 25 comprises a generally cuboid-shaped preferably one-piece substrate 160 formed of a piezoelectric material, such as lead zirconium titanate (PZT), which is responsive to electrical stimuli. In the preferred embodiment of the invention, piezoelectric substrate 160 is poled generally in the direction of an arrow 165. Of course, the poling direction may be oriented in other directions, if desired, such as in a direction perpendicular to the poling direction shown by arrow 165. Cut into substrate 160 are a plurality of elongate ink channels 170. Each of the channels 170 has a channel outlet 175 at an end 177 thereof and an open side 178. Ink channels 170 are covered at outlets 175 by a nozzle plate (not shown) having a plurality of orifices (also not shown) of predetermined nominal diameter aligned with respective ones of channel outlets 175, so that ink droplets 20 are ejected from channel outlets 175 and through their respective orifices. A rear cover plate (not shown) is also provided for capping the rear of channels 175. In addition, a top cover plate 179 caps chambers 170 along open side 178. During operation of apparatus 10, ink from reservoir 140 is controllably supplied to each channel 175 by means of conduit 150.

Figure 5:
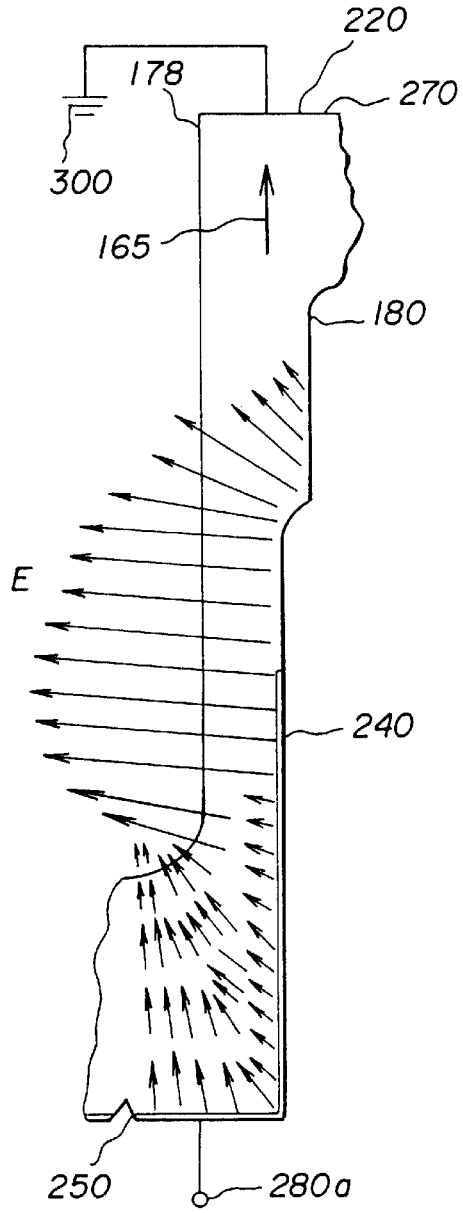
FIG. 5 is a view in elevation of a first one of the side walls including a portion of the ink channel, this view also showing a general direction of an electric field supplied through the side wall.

Still referring to FIGS. 2 and 3, substrate 160 includes a first side wall 180 and a second side wall 190 defining channel 170 therebetween, which channel 170 is adapted to receive an ink body 200 (see FIG. 8) therein. As shown in FIGS. 2 and 3, first side wall 180 has an outside surface 185 and second side wall 190 has an outside surface 195. Substrate 160 also includes a base 210 interconnecting first side wall 180 and second side wall 190, so as to form a generally U-shaped structure comprising the piezoelectric material. Upper-most surfaces (as shown) of first wall 180 and second wall 190 together define a top surface 220 of substrate 160 and a lower-most surface (as shown) of base 210 defines a bottom surface 230 of substrate 160. An addressable first electrode actuator layer 240 may extend from a notch 250 cut in base 210 to approximately half-way up second outside surface 195. Similarly, an addressable second electrode actuator layer 260 may extend from notch 250 to approximately halfway up first outside surface 185. Notch 250, which may have an inverted V-shape, is cut in substrate 160 such that it extends in substrate 160 parallel to channel 170 and to the same lengthwise extent as channel 170. The purpose of notch 250 is to electrically disconnect first layer 240 and second layer 260 because presence of notch 250 prevents contact between first layer 240 and second layer 260. In this configuration of layers 240/260, an electrical field "E" (see FIG. 5) is established in a predetermined orientation with respect to poling direction 165, as described in more detail hereinbelow. Moreover, as shown in FIGS. 2 and 3, first layer 240 and second layer 260 are each connected to the previously mentioned pulse generator 80. Pulse generator 80 supplies electrical drive signals to first layer 240 and second layer 260 via a first electrical conducting terminal 280*a* and a second electrical conducting terminal 280*b*, respectively.

Referring yet again to FIGS. 2 and 3, a common electrode layer 290 coats each channel 170 and also extends therefrom along top surface 220. Common electrode layer 290 is preferably connected to a ground electric potential, as at a point 300. Alternatively, common electrode layer 290 may be connected to pulse generator 80 for receiving electrical drive signals therefrom. However, it is preferable to maintain common electrode layer 290 at ground potential because common electrode layer 290 is in contact with ink in channel 170. That is, it is preferable to maintain common electrode layer 290 at ground potential in order to minimize electrolysis effects on common electrode layer 290 when in contact with liquid ink in channel 170, which electrolysis may otherwise act to degrade performance of common electrode layer 290 as well as the ink.

As best seen in FIG. 2, each pair of "neighboring" ink channels 170 is separated by a cut-out 305, which may be filled with air or an resilient elastomer (not shown), for reducing mechanical "cross-talk" between channels 170. Such cross-talk between the channels 170 would otherwise interfere with precise ejection of ink droplets 20 from any neighboring channels 170. Interference with precise ejection of ink droplets 20 in turn reduces accuracy of ink droplet placement on receiver medium 30. Each cut-out 305 is defined between respective pairs of side walls 180/190, so that channels 170 are mechanically decoupled by presence of cut-outs 305. It should be apparent from the description herein that the terminology "neighboring" ink channels means ink channels 170 that would otherwise be adjacent but for the intervening cut-out 305.

Referring now to FIGS. 4, 5, 8, 9*a* and 9*b*, there is shown substrate 160 undergoing symmetrical deformation in order to symmetrically pressurize ink body 200 residing in channel 170 and thereby eject ink droplet 20 along a first ejection path 307 normal to channel outlet 175. To achieve symmetrical pressurization of ink body 200, pulse generator 80 supplies a first electrical pulse 310 to first layer 240. First pulse 310 has a predetermined amplitude $V_1$, a width $\Delta t_1$ and a start time $t_1$. Pulse generator 80 also supplies a second electrical pulse 320 to second layer 260. Second pulse 320 has a predetermined amplitude $V_2$ identical to amplitude $V_1$, a width $\Delta t_2$ identical to width $\Delta t_1$, and a start time $t_2$ identical to start time $t_1$. Substrate 160, which is responsive to the electrical stimuli supplied by pulses 310/320 to layers 240/260, respectively, deforms such that first side wall 180 and second side wall 190 simultaneously inwardly move to positions 180' and 190', as shown by phantom lines. Moreover, base 210 will likewise inwardly move to position 210', as shown by phantom lines. First side wall 180, second side wall 190 and base 210 move due to the inherent nature of piezoelectric materials, such as the piezoelectric material forming substrate 160. In this regard, it is known that when an electrical signal is applied to a piezoelectric material, mechanical distortion occurs in the piezoelectric material. This mechanical distortion is dependent on the poling direction and the direction of the applied electrical field. Thus, according to the present invention, electric field "E" is established between electrode layers 240/260 and common electrode layer 270 and is in a direction generally parallel to poling direction 165 near base 210 in order to cause base 210 to deform and compress to position 210' in non-shear mode. In addition, electric field "E" is in a direction generally perpendicular to poling direction 165 near side walls 180/190 to cause side walls 180/190 to deform to positions 180'/190' in shear mode. That is, side walls 180/190 will deform into a generally parallelogram shape, rather than the compressed shape in which base 210 deforms. In this manner, substrate 160 becomes longer and thinner in a direction parallel to poling direction 165. Once electrical pulses 310 and 320 cease, side walls 180/190 and base 210 return to their undeformed positions to await further electrical excitation. However, it may be appreciated that, due to the inherent nature of piezoelectric materials, an applied voltage of one polarity (i.e., either positive or negative polarity) will cause substrate 165 to bend in a first direction and an applied voltage of the opposite polarity will cause substrate 165 to deform in a second direction opposite to the first direction.

Referring to FIGS. 5, 6, 7, 8, 10*a*, 10*b*, 11*a* and 11*b*, there is shown substrate 160 undergoing asymmetrical deformation in order to asymmetrically pressurize ink body 200 residing in channel 170 and thereby eject ink droplet 20 along a second ejection path 325 at a first predetermined angle "α" and along a third ejection path 327 at a second predetermined angle "β" with respect to a longitudinal axis of channel 170. Asymmetrical pressurization of ink body 200 is caused by asymmetrically actuating side walls 180/190. It may be appreciated that the size of the nozzle orifice of the nozzle plate (not shown) is large enough such that the orifice size necessarily does not affect (e.g., reduce) the assymmetric pressurization of ink body 200.

Figure 6:
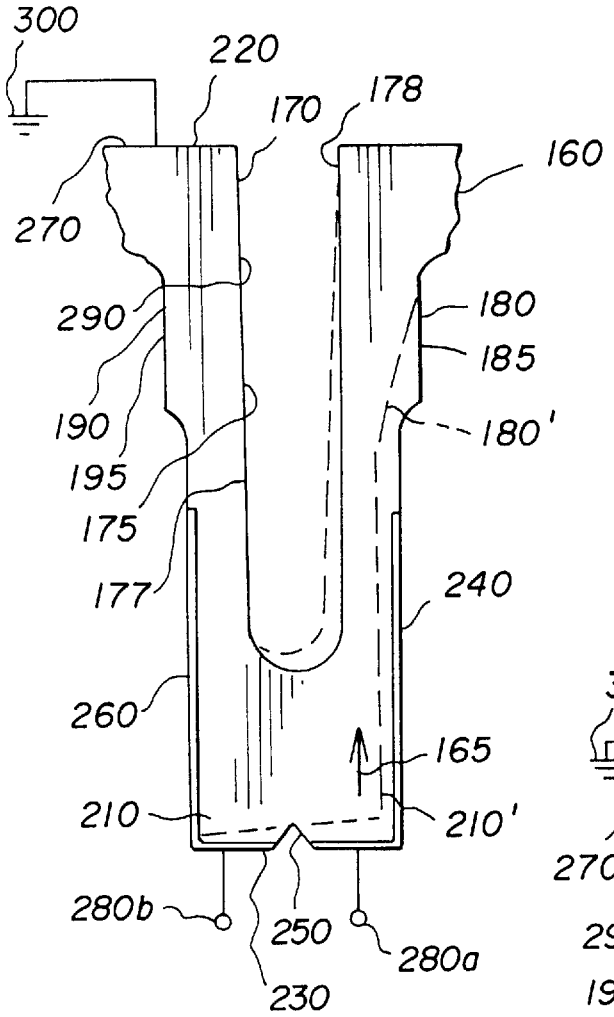
FIG. 6 is a view in elevation the two side walls, this view showing the first one of the side walls moving.
Figure 10A:
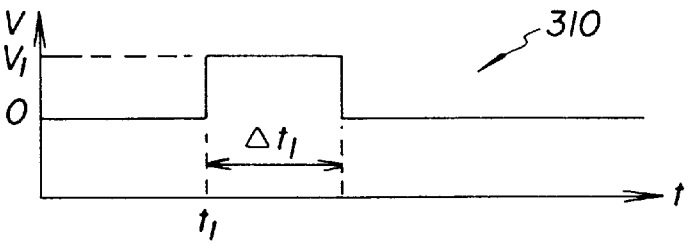
FIG. 10*a* is a graph illustrating a first electrical pulse as a function of time, the first electrical pulse having a predetermined amplitude, width and start time.
Figure 10B:
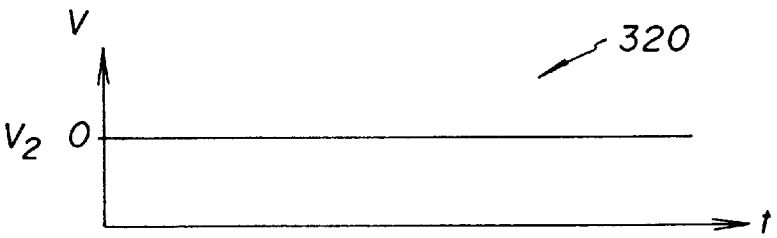
FIG. 10*b* is a graph illustrating an electrical signal as a function of time without a pulse present (i.e., a second electrical pulse having zero amplitude)
Figure 15:
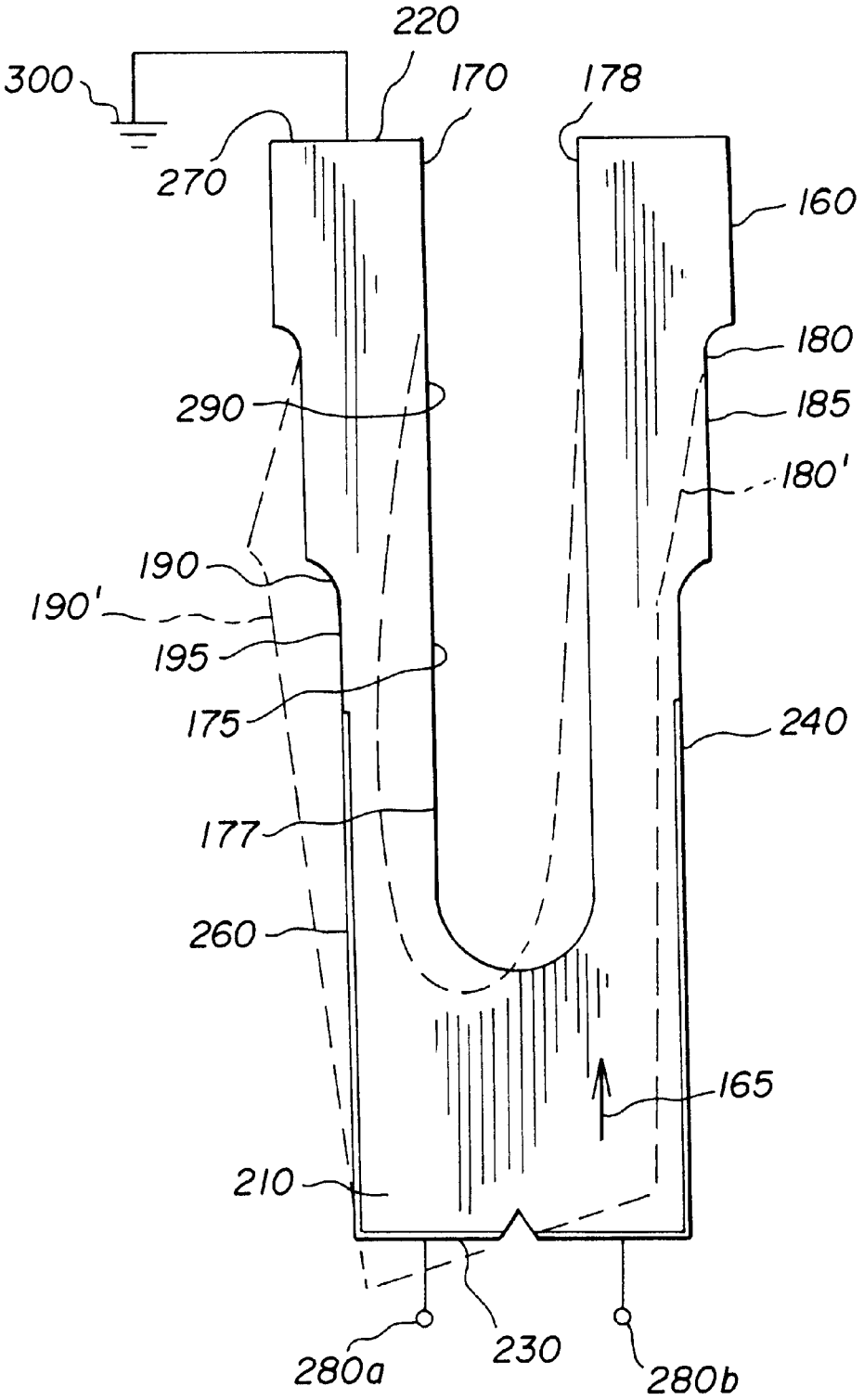
FIG. 15 is a view in elevation of the two side walls, this view showing the second one of the side walls moving in the same direction as the first one of the side walls.

As shown in FIGS. 6, 10*a* and 10*b*, asymmetrically deformed side walls 180/190 and base 210 are produced by asymmetrically-driven electric waveforms applied to the two electric terminals 280*a*/280*b* on the two side walls 180/190. To achieve asymmetrical pressurization of ink body 200, pulse generator 80 does not supply a second electrical pulse 320 to second layer 260. However, pulse generator 80 supplies a first electrical pulse 320 to first layer 240. In this regard, first pulse 310 has a predetermined amplitude $V_1$, width $\Delta t_1$ and start time $t_1$. Substrate 160, which is responsive to the electrical stimuli supplied by pulse 310 to first layer 240 deforms such that first side wall 180 inwardly moves to position 180', as shown by phantom lines. Moreover, base 210 will likewise inwardly move to position 210', as shown by phantom lines. It may be appreciated that, alternatively, pulse generator 80 can be caused not to supply first electrical pulse 310 to first layer 240. However, in this case, pulse generator 80 supplies second electrical pulse 320 to second layer 240. Also in this alternative case, second pulse 320 would have a predetermined amplitude $V_2$, width $\Delta t_2$ and start time $t_2$.

Figure 7:
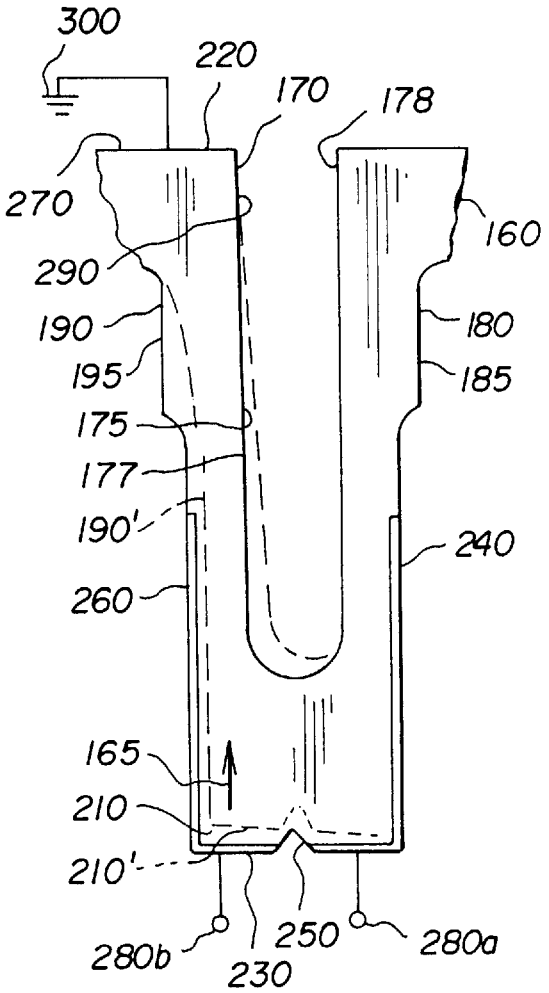
FIG. 7 is a view in elevation the two side walls, this view showing the second one of the side walls moving.

FIGS. 7, 11*a* and 11*b*, also show that asymmetrically deformed side walls 180/190 and base 210 are produced by asymmetrically-driver electric waveforms applied to the two electric terminals 280*a*/280*b* on the two side walls 180/190. In this regard, substrate 160 undergoes asymmetrical deformation in order to asymmetrically pressurize ink body 200 residing in channel 170. As ink body 200 is asymmetrically pressurized, ink droplet 20 travels along third ejection path 327 at the second predetermined angle "β" with respect to the longitudinal axis of channel 170. To achieve asymmetrical pressurization of ink body 200, pulse generator 80 supplies a first electrical pulse 310 to first layer 240. First pulse 310 has a predetermined amplitude $V_1$, a width $\Delta t_1$ and a start time $t_1$. Pulse generator 80 also supplies a second electrical pulse 320 to second layer 260. Second pulse 320 has a predetermined amplitude $V_2$ less than (i.e., different from) amplitude $V_1$. However, second pulse 320 has a width $\Delta t_2$ identical to width $\Delta t_1$, and a start time $t_2$ identical to start time $t_1$. Substrate 160, which is responsive to the electrical stimuli supplied by pulses 310/320 to layers 240/260, respectively, deforms such that second side wall 190 inwardly moves less than first side wall 180. Moreover, base 210 will inwardly move to position 210', as shown by phantom lines.

Referring to FIGS. 4, 5, 12*a* and 12*b*, there is shown substrate 160 undergoing asymmetrical deformation in order to asymmetrically pressurize ink body 200 residing in channel 170 and thereby eject ink droplet 20 along an ejection path at a third angle (not shown) with respect to the longitudinal axis of channel 170. It may be appreciated from the teachings herein that the third predetermined angle is necessarily different from first angle "α" and second angel "β". To achieve asymmetrical pressurization of ink body 200, pulse generator 80 supplies a first electrical pulse 310 to first layer 240. First pulse 310 has a predetermined amplitude $V_1$, a width $\Delta t_1$ and a start time $t_1$. Pulse generator 80 also supplies a second electrical pulse 320 to second layer 260. Second pulse 320 has a predetermined amplitude $V_2$ identical to amplitude $V_1$ and a width $\Delta t_2$ identical to width $\Delta t_1$. However, second pulse 320 has a start time $t_2$ after start time $t_1$. Substrate 160, which is responsive to the electrical stimuli supplied by pulses 310/320 to layers 240/260, respectively, deforms such that first side wall 180 and second side wall 190 inwardly move starting at different times. Moreover, base 210 will inwardly move to position 210', as shown by phantom lines.

Referring to FIGS. 4, 5, 8, 13*a* and 13*b*, there is shown substrate 160 undergoing asymmetrical deformation in order to asymmetrically pressurize ink body 200 residing in channel 170 and thereby eject ink droplet 20 along an ejection path at a fourth predetermined angle (not shown) with respect to the longitudinal axis of channel 170. To achieve asymmetrical pressurization of ink body 200, pulse generator 80 supplies a first electrical pulse 310 to first layer 240. First pulse 310 has a predetermined amplitude $V_1$, a width $\Delta t_1$ and a start time $t_1$. Pulse generator 80 also supplies a second electrical pulse 320 to second layer 260. Second pulse 320 has a predetermined amplitude $V_2$ identical to amplitude $V_1$ and a start time identical to start time $t_1$. However, second pulse 320 has a width $\Delta t_2$ different from width $\Delta t_1$. Substrate 160, which is responsive to the electrical stimuli supplied by pulses 310/320 applied to layers 240/260, respectively, deforms such that first side wall 180 and second side wall 190 inwardly move for different time durations. Moreover, base 210 will inwardly move to position 210', as shown by phantom lines.

Referring to FIGS. 4, 5, 8, 14*a*, 14*b* and 15, there is shown substrate 160 undergoing asymmetrical deformation in order to asymmetrically pressurize ink body 200 residing in channel 170 and thereby eject ink droplet 20 along an ejection path at a fifth predetermined angle (not shown) with respect to the longitudinal axis of channel 170. To achieve asymmetrical pressurization of ink body 200, pulse generator 80 supplies a first electrical pulse 310 to first layer 240. First pulse 310 has a predetermined amplitude $V_1$, a width $\Delta t_1$ and a start time $t_1$. Pulse generator 80 also supplies a second electrical pulse 320 to second layer 260. Second pulse 320 has a width $\Delta t_2$ identical to width $\Delta t_1$. However, second pulse 320 has a predetermined amplitude $V_2$ different from amplitude $V_1$ and of opposite polarity, so that second side wall 190 moves in the same direction as first side wall 180. In addition, second pulse 320 has a start time $t_2$ before start time $t_1$. Substrate 160, which is responsive to the electrical stimuli supplied by pulses 310/320 to layers 240/260, respectively, deforms such that first side wall 180 and second side wall 190 move in the same direction starting at different times. Moreover, base 210 will inwardly move to position 210', as shown by phantom lines. It may be understood that the amplitudes, pulse widths and timing offset of pulses 310 and 320 in the examples hereinabove may be optimized to achieve precise ink droplet placement for specific print head dimensions and materials. In addition, it me be understood that amplitudes, pulse widths and timing offset of pulses 310 and 320 in the examples hereinabove may be optimized to control tone scales by controlling volume of ink droplets 20 ejected from printhead 25. This is so because ink pressure can be produced at finer pressure steps by side walls 180/190 being selectively actuated to various degrees compared to the situation when both side walls 180/190 of ink channels 170 are actuated simultaneously and to the same extent. This flexibility of controlling actuation of the two side walls 180/190 provides for more gradual and finer changes in volume of ejected ink droplet 20. Due to these combined effects, a wider and finer tone scale can be achieved by printhead 25 in accordance with the present invention.

It is understood from the description hereinabove that an advantage of the present invention is that direction of ink droplet ejection can be controlled. This is so because side walls 180/190 are capable of selectively deforming to asymmetrically pressurize ink body 200 and thereby eject ink droplet 20 along a predetermined trajectory.

Another advantage of the present invention is that mechanical "cross-talk" between neighboring ink channels is reduced. This is so because presence of cut-out 305 mechanically decouples one channel 170 from its neighboring channel 170.

Yet another advantage of the present invention is that ink droplet ejection direction may be easily varied without disassembly of the printer apparatus. This is so because amplitudes, widths and starting times of pulses 310/320 may be individually varied to vary the timing and amount of deformation of side walls 180/190, which in turn varies ejection direction of ink droplets 20 without requiring disassembly of printer apparatus 10.

Still another advantage of the present invention is that tone scales can be controlled by fine control of volume of ink droplets 20 ejected from printhead 25. This is so because each side wall 180/190 of ink channel 170 can be separately controlled. In this manner, ink pressure can be produced at finer pressure steps compared to the situation when both side walls 180/190 of ink channels 170 are actuated simultaneously. The flexibility of controlling actuation of the two side walls 180/190 also provides more gradual and finer changes in volume of ejected ink droplet 20 and thus, more gradual and finer changes in tone scales.

The invention has been described in detail with particular reference to certain preferred embodiments thereof, but it will be understood that variations and modifications can be effected within the spirit and scope of the invention. For example, pulses 310/320 are illustrated herein as "square wave" pulses. However, other pulse shapes may be used, such as triangular or sinusoidal pulse shapes, if desired.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a printer apparatus and method therefor capable of varying direction of an ink droplet to be ejected therefrom for improved accuracy of ink droplet placement.

PARTS LIST

α . . . first predetermined angle
β . . . second predetermined angle
10 . . . printer apparatus
20 . . . ink droplet
25 . . . printhead
30 . . . receiver
40 . . . image source
50 . . . image processor
60 . . . halftoning unit
70 . . . image memory
80 . . . pulse generator
90*a* . . . first actuator
90*b* . . . second actuator
100 . . . transport mechanism
110 . . . transport control
120 . . . controller
130 . . . ink pressure regulator
140 . . . ink reservoir
150 . . . conduit
160 . . . substrate
165 . . . arrow
170 . . . ink channels
175 . . . channel outlet
177 . . . end of channel
178 . . . open side of channel
179 . . . top cover plate
180 . . . first side wall
180' . . . deformed position of first side wall

185 . . . outside surface of first side wall
190 . . . second side wall
190' . . . deformed position of second side wall
195 . . . outside surface of second side wall
200 . . . ink body
210 . . . base
210' . . . deformed position of base
220 . . . top surface
230 . . . bottom surface
240 . . . first electrode actuator layer
250 . . . notch
260 . . . second electrode actuator layer
270 . . . common electrode layer
280*a* . . . first electrical terminal
280*b* . . . second electrical terminal
290 . . . common electrode layer
300 . . . electrical ground
305 . . . cut-out
307 . . . first ejection path
310 . . . first pulse
320 . . . second pulse
325 . . . second ejection path
327 . . . third ejection path

What is claimed is:

1. A printer apparatus, comprising:

(a) a printhead having a first side wall and a second side wall defining a chamber therebetween;

(b) a first actuator coupled to the first side wall and a second actuator coupled to the second side wall for selectively moving the first side wall and the second side wall to asymmetrically pressurize the chamber; and (c) a pulse generator coupled to said actuators for supplying a first electrical pulse to said first actuator and a second electrical pulse to said second actuator, so that said first and said second actuators are selectively electrically actuated, wherein the first pulse has a predetermined width different from a predetermined width of the second pulse.

2. The apparatus of claim 1, further comprising a controller connected to said actuators for controllably actuating said actuators.

3. A printer apparatus capable of ejecting an ink droplet therefrom in a predetermined direction, comprising:

(a) a printhead having a first side wall and a second side wall defining a channel therebetween having an ink body therein, the first side wall and the second side wall being selectively movable for asymmetrically pressurizing the ink body;

(b) a first actuator coupled to the first side wall and a second actuator coupled to the second side wall for selectively moving the first side wall and the second side wall, whereby movement of the first side wall asymmetrically pressurizes the ink body to eject the ink droplet therefrom and out the channel along a first predetermined direction and whereby movement of the second side wall asymmetrically pressurizes the ink body to eject the ink droplet therefrom and out the channel along a second predetermined direction; and (c) a pulse generator coupled to said actuators for supplying a first electrical pulse to said first actuator and a second electrical pulse to said second actuator, so that said first and said second actuators are selectively electrically actuated, wherein the first pulse has a predetermined width different from a predetermined width of the second pulse.

4. The apparatus of claim 3, further comprising a controller connected to said actuators for controllably actuating said actuators.

5. The apparatus of claim 3, wherein said actuators are electrically actuatable.

6. The apparatus of claim 3, wherein the first pulse and the second pulse are positive in polarity.

7. The apparatus of claim 6, (a) wherein the first pulse has a predetermined amplitude different from a predetermined amplitude of the second pulse; and (b) wherein the first pulse has a predetermined start time identical to a predetermined start time of the second pulse.

8. The apparatus of claim 6, (a) wherein the first pulse has a predetermined amplitude different from a predetermined amplitude of the second pulse; and (b) wherein the first pulse has a predetermined start time different from a predetermined start time of the second pulse.

9. The apparatus of claim 3, wherein the first pulse is positive in polarity and the second pulse is negative in polarity, the first pulse having a predetermined start time after a predetermined start time of the second pulse.

10. The apparatus of claim 3, wherein said printhead comprises a plurality of pairs of opposing side walls defining a plurality of channels between adjacent ones of the side walls, each pair of side walls being separated by a cut-out for reducing mechanical cross-talk between the channels as any one of the side walls moves.

11. A printer apparatus capable of ejecting an ink droplet therefrom in a predetermined direction, comprising:

(a) a printhead having a first side wall and a second side wall defining a channel therebetween having an ink body therein, the first side wall and the second side wall being selectively movable for asymmetrically pressurizing the ink body; and (b) a first electrically actuatable actuator coupled to the first side wall and a second electrically actuatable actuator coupled to the second side wall for selectively moving the side walls, whereby movement of the first side wall asymmetrically pressurizes the ink body to eject the ink droplet therefrom and out the channel along a first predetermined direction and whereby movement of the second side wall asymmetrically pressurizes the ink body to eject the ink droplet therefrom and out the channel along a second predetermined direction;

(c) a pulse generator coupled to said actuators for supplying a first electrical pulse to said first actuator and a second electrical pulse to said second actuator, so that said first and said second actuators are selectively actuated, wherein the first pulse has a predetermined width different from a predetermined width of the second pulse; and (d) a controller connected to said pulse generator for controlling said pulse generator.

12. The apparatus of claim 11, wherein the first pulse and the second pulse are positive in polarity.

13. The apparatus of claim 12, (a) wherein the first pulse has a predetermined amplitude different from a predetermined amplitude of the second pulse; and (b) wherein the first pulse has a predetermined start time identical to a predetermined start time of the second pulse.

14. The apparatus of claim 12, (a) wherein the first pulse has a predetermined amplitude different from a predetermined amplitude of the second pulse; and (b) wherein the first pulse has a predetermined start time different from a predetermined start time of the second pulse.

15. The apparatus of claim 11, wherein the first pulse is positive in polarity and the second pulse is negative in polarity, the first pulse having a predetermined start time after a predetermined start time of the second pulse.

16. The apparatus of claim 11, wherein said printhead comprises a plurality of pairs of opposing side walls defining a plurality of channels between adjacent ones of the side walls, each pair of side walls being separated by a cut-out for reducing mechanical cross-talk between the channels as any one of the side walls move.

17. A printhead, comprising:

(a) a first side wall and a second side wall defining a chamber therebetween;

(b) a first actuator coupled to the first side wall and a second actuator coupled to the second side wall for selectively moving the first and second side walls to asymmetrically pressurize the chamber; and (c) a pulse generator coupled to said actuators for supplying a first electrical pulse to said first actuator and a second electrical pulse to said second actuator, so that said first and said second actuators are selectively electrically actuated, wherein the first pulse has a predetermined width different from a predetermined width of the second pulse.

18. A printhead capable of ejecting an ink droplet therefrom in a predetermined direction, comprising:

(a) a movable first side wall;

(b) a movable second side wall opposing said first side wall, said first side wall and said second side wall being selectively movable and defining a channel therebetween having an ink body therein;

(b) a first actuator coupled to said first side wall and a second actuator coupled to said second side wall for selectively moving said first side wall and said second side wall, whereby movement of said first side wall asymmetrically pressurizes the ink body to eject the ink droplet therefrom and out the channel along a first predetermined direction and whereby movement of said second side wall asymmetrically pressurizes the ink body to eject the ink droplet therefrom and out the channel along a second predetermined direction; and (c) a pulse generator coupled to said actuators for supplying a first electrical pulse to said first actuator and a second electrical pulse to said second actuator, so that said first and said second actuators are selectively electrically actuated, wherein the first pulse has a predetermined width different from a predetermined width of the second pulse.

19. The apparatus of claim 18, wherein said actuators are electrically actuatable.

20. The apparatus of claim 18, further comprising a plurality of pairs of opposing side walls defining a plurality of channels between adjacent ones of the side walls, each pair of side walls being separated by a cut-out for reducing mechanical cross-talk between the channels as any one of the side walls moves.

21. In association with a printer having a chamber therein for ejecting an ink droplet therefrom, a method of ejecting the ink droplet from the chamber in a predetermined direction, comprising the steps of:

(a) using a print head having a first side wall and a second side wall defining the chamber therebetween;

(b) selectively moving the side walls by using a first actuator coupled to the first side wall and a second actuator coupled to the second side wall to asymmetrically pressurize the chamber so that the ink droplet is directed out the chamber in a predetermined direction and (c) supplying a first electrical pulse to the first actuator and a second electrical pulse to the second actuator by using a pulse generator coupled to the actuators, so that the first and the second actuators are selectively actuated, wherein the first pulse has a predetermined width different from a predetermined width of the second pulse.

22. The method of claim 21, further comprising the step of controllably actuating the actuators using a controller connected to the actuators.

23. In association with a printer having a channel therein for ejecting an ink droplet therefrom, a method of ejecting the ink droplet from the channel in a predetermined direction, comprising the steps of:

(a) disposing an ink body in a channel defined by a first side wall opposite a second side wall, the first side wall and the second side wall being selectively movable for asymmetrically pressurizing the ink body;

(b) selectively moving the side walls by actuating a first actuator coupled to the first side wall and by actuating a second actuator coupled to the second side wall, whereby movement of the first side wall asymmetrically pressurizes the ink body to eject the ink droplet therefrom and out the channel along a first predetermined direction and whereby movement of the second side wall asymmetrically pressurizes the ink body to eject the ink droplet therefrom and out the channel along a second predetermined direction; and (c) supplying a first electrical pulse to the first actuator and a second electrical pulse to the second actuator by using a pulse generator coupled to the actuators, so that the first and the second actuators are selectively actuated, wherein the first pulse has a predetermined width different from a predetermined width of the second pulse.

24. The method of claim 23, further comprising the step of controllably actuating the actuators by using a controller connected to the actuators.

25. The method of claim 23, wherein the step of selectively moving the side walls comprises the step of selectively moving the side walls by electrically actuating the first actuator and by electrically actuating the second actuator.

26. The method of claim 23, wherein the step of supplying the first electrical pulse to the first actuator and the second electrical pulse to the second actuator comprises the step of supplying the first pulse having positive polarity and the second pulse having negative polarity, the first pulse having a predetermined start time after a predetermined start time of the second pulse.

27. The method of claim 23, wherein the step of supplying the first electrical pulse to the first actuator and the second electrical pulse to the second actuator comprises the step of supplying a first pulse of positive polarity and a second pulse of positive polarity.

28. The method of claim 27, (a) wherein the step of supplying the first pulse and the second pulse comprises the step of supplying the first pulse having a predetermined amplitude different from a predetermined amplitude of the second pulse; and (b) wherein the step of supplying the first pulse and the second pulse comprises the step of supplying the first pulse having a predetermined start time identical to a predetermined start time of the second pulse.

29. The method of claim 27, (a) wherein the step of supplying the first pulse and the second pulse comprises the step of supplying the first pulse having a predetermined amplitude different from a predetermined amplitude of the second pulse; and (b) wherein the step of supplying the first pulse and the second pulse comprises the step of supplying the first pulse having a predetermined start time different from a predetermined start time of the second pulse.

30. The method of claim 23, wherein the step of using the printhead comprises the step of using a printhead having a plurality of pairs of opposing side walls defining a plurality of channels between adjacent ones of the side walls, each pair of side walls being separated by a cut-out for reducing mechanical cross-talk between the channels as any one of the side walls moves.

31. In association with a printhead having a chamber therein for ejection of an ink droplet therefrom, a method of ejecting the ink droplet from the chamber in a predetermined direction, comprising the steps of:

(a) using a first side and a second side wall defining the chamber therebetween; and (b) selectively moving the side walls by using a first actuator coupled to the first side wall and a second actuator coupled to the second side wall to asymmetrically pressurize the chamber; and (c) supplying a first electrical pulse to the first actuator and a second electrical pulse to the second actuator by using a pulse generator coupled to the actuators, so that the first and the second actuators are selectively actuated, wherein the first pulse has a predetermined width different from a predetermined width of the second pulse.

32. In association with a printhead having a chamber therein for ejection of an ink droplet therefrom, a method of ejecting the ink droplet from the chamber in a predetermined direction, comprising the steps of:

(a) using a first side wall and a second side wall opposing the first side wall, the first side wall and the second side wall being selectively movable and defining a channel therebetween having an ink body therein;

(b) selectively moving the side walls by using a first actuator coupled to the first side wall and a second actuator coupled to the second side wall, whereby movement of the first side wall asymmetrically pressurizes the ink body to eject the ink droplet therefrom and out the channel along a first predetermined direction and whereby movement of the second side wall asymmetrically pressurizes the ink body to eject the ink droplet therefrom and out the channel along a second predetermined direction; and (c) supplying a first electrical pulse to the first actuator and a second electrical pulse to the second actuator by using a pulse generator connected to the first and second actuators, wherein the first pulse has a predetermined width different from a predetermined width of the second pulse.

33. The method of claim 32, wherein the step of selectively moving the side walls by using a first actuator coupled to the first side wall and a second actuator coupled to the second side wall comprises the step of selectively moving the side walls by using a first actuator electrically coupled to the first side wall and a second actuator electrically coupled to the second side wall.

34. The method of claim 32, further comprising the step of reducing mechanical cross-talk between a plurality of channels defined between respective pairs of the side walls as any one of the side walls move, each of the pairs of side walls being separated by a cut-out.

* * * * *